US006395440B1

(12) United States Patent
Yamaguchi et al.

(10) Patent No.: US 6,395,440 B1
(45) Date of Patent: May 28, 2002

(54) ELECTROPHOTOGRAPHIC PHOTORECEPTOR, PROCESS CARTRIDGE AND ELECTROPHOTOGRAPHIC APPARATUS USING THE SAME

(75) Inventors: Yasuhiro Yamaguchi; Masakazu Iijima; Fumiaki Tambo; Masahiro Iwasaki; Taketoshi Hoshizaki; Yasuo Sakaguchi, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/706,864

(22) Filed: Nov. 7, 2000

(30) Foreign Application Priority Data

Mar. 21, 2000 (JP) ..... 2000-078278

(51) Int. Cl.[7] ..... G03G 5/047
(52) U.S. Cl. ..... 430/58.7; 430/59.6
(58) Field of Search ..... 430/596, 58.65, 430/59.1, 59.5, 58.7

(56) References Cited

U.S. PATENT DOCUMENTS 5,681,677 A * 10/1997 Bugner et al. ..... 430/59.6
5,952,140 A * 9/1999 Visser et al. ..... 430/58.5
6,020,097 A * 2/2000 Visser et al. ..... 430/66

FOREIGN PATENT DOCUMENTS

| | | |
|---|---|---|
| JP | A-3-256050 | 11/1991 |
| JP | A-5-150495 | 6/1993 |
| JP | A-5-249706 | 9/1993 |
| JP | A-10-182760 | 7/1998 |

* cited by examiner

*Primary Examiner*—John Goodrow
(74) *Attorney, Agent, or Firm*—Oliff & Berridge, PLC

(57) ABSTRACT

An electrophotographic photoreceptor having a bipolar charge transport layer with a hole-transporting property and an electron-transporting property, the bipolar charge transport layer containing a block copolymer or a graft copolymer, and a process cartridge and an electrophotographic apparatus using the electrophotographic photoreceptor. The electrophotographic photoreceptor has a high performance and a long life and can provide various properties required for a photoreceptor by forming, the bipolar charge transport layer which is excellent in hole- and electron-transporting properties, mechanical strengths, a discharge product resistance and a coating dispersion stability, and the process cartridge and the electrophotographic apparatus using the electrophotographic photoreceptor can provide a high performance and a high durability.

12 Claims, 2 Drawing Sheets

ELECTROPHOTOGRAPHIC PHOTORECEPTOR, PROCESS CARTRIDGE AND ELECTROPHOTOGRAPHIC APPARATUS USING THE SAME

FIELD OF THE INVENTION

The present invention relates to an electrophotographic photoreceptor excellent in charge-transporting property and mechanical properties, and a process cartridge and an electrophotographic apparatus using the same.

DESCRIPTION OF THE RELATED ART

In recent years, an electrophotographic technology has played a central part in an image output field of copiers, printers and facsimiles because of advantages that high printing qualities can be obtained at high speed. As a structural material of an electrophotographic photoreceptor which is the heart of the electrophotographic technology, inorganic photoconductive materials such as selenium, a selenium-tellurium alloy and a selenium-arsenic alloy have been widely used from the beginning. Meanwhile, the study and the development of an electrophotographic photoreceptor using organic photoconductive materials which are superior to these inorganic photoreceptors in costs, productivity and disposability have been increasingly conducted, and they have currently exceeded the inorganic photoreceptors. Especially, selection of the materials can be more freely conducted by introduction of functional separation designing that charge generation and charge transport being basic steps of photoconduction are conducted by separate materials, and the remarkable improvement of performance has been achieved on the basis of the diversity provided by organic materials. At present, a functional separation laminated organic photoreceptor in which a thin-film charge-generating layer having a charge-generating function and a thick-film charge transport layer having a charge transport function, a chargeability and mechanical strengths are laminated on an electroconductive substrate has been mainly used as an electrophotographic photoreceptor.

Most of the organic charge-transporting materials are hole-transporting materials such as triphenylamine derivatives and hydrazone derivatives, and electron-transporting materials having performance of practical level are rare. Because of this restriction of materials and the structure made of the electroconductive support, the charge-generating layer and the charge transport layer, the organic photoreceptor has generally such a restriction of an driving polarity that it is driven only by negative charging.

With respect to the driving polarity, there are desirable polarities according to a sub-system and a total system used. In order to use the organic photoreceptors more widely and efficiently, the development of negative charging-type, positive charging-type and further bipolar charging-type photoreceptors has been in demand.

For example, when a wire discharge-type charging unit such as an inexpensive scorotron is used as a charging sub-system, there is a problem that harmful gases such as ozone and nitrogen oxides are generated in the discharge. It is known that amounts of the harmful gases generated are smaller by one figure in the positive charging than in the negative charging with the same charging unit. Thus, a positive charging-type photoreceptor has been demanded in a less costly and/or small-sized electrophotographic apparatus in which a filter for removing harmful gases cannot be mounted.

On the other hand, with respect to the requirement of the high image quality, it is advisable to conduct discharge area development using a negative charging-type photoreceptor in using the existing developer. At this time, to cope with the removal of harmful gases, it is required to use a filter of activated carbon or to use a charging unit of a contact charging system in which amounts of harmful gases are reduced.

Further, when the discharge area development system is employed to conduct transfer electrostatically, the charging polarity in transfer is reverse to the charging polarity in latent image formation. Since the charging in transfer is conducted in theory through a transfer material such as paper or a film for primary transfer, a photoreceptor is not directly charged. However, the photoreceptor is actually charged with polarity which is reverse to that in latent image formation between the transfer material and the next transfer material. In this case, the charging with reverse polarity in the transfer cannot be optically extinguished in the photoreceptor which is actuated only with monopolarity. Accordingly, a problem sometimes occurs that in some ability of the charging unit, the history thereof appears in the next copy or print. This problem is basically solved by using a bipolar charging-type photoreceptor having a hole-transporting property and an electron-transporting property.

Meanwhile, the functional separation laminated organic photoreceptor has the following defects owing to the laminated structure, and the development of a photoreceptor capable of conquering these defects has been in demand.

With respect to the first defect owing to the laminated structure, there are problems that since two or more layers have to be formed in comparison with the single-layer photoreceptor, the productivity is decreased and the costs are increased.

With respect to the second defect owing to the laminated structure, when a dip coating method is used which is a film-forming method generally employed because of high mass productivity, care must be taken not to attack a lower layer in coating an upper layer and a resistance to an upper layer coating solvent is required for a lower layer material, and there are problems accompanied by the same.

That is, a charge-generating layer which is generally a lower layer is made of a pigment as a charge-generating material and a binder resin having a film-forming property. A material which is not attacked by a coating solvent of a charge transport layer as an upper layer has to be selected as the binder resin. Generally, the charge-transporting material has a relatively low polarity. A solvent having a relatively low polarity, such as toluene, chlorobenzene, tetrahydrofuran, dioxane or dichloromethane is used as the coating solvent. Accordingly, as the binder resin of the charge-generating layer, a thermoplastic resin having a high polarity, such as an acetal-modified vinyl alcohol resin or a vinyl chloride-vinyl acetate-maleic anhydride copolymer resin having a low solubility in the solvents is employed.

It has been; however, known that a charge-transporting property is decreased in resins having a high polarity. Further, the resins having the high polarity are sometimes problematic in that they have a high moisture absorption and cause change in photoelectric characteristics accompanied by high environmental change. Further, since these thermoplastic resins having the high polarity are not completely insoluble, somewhat roughening is unavoidable in coating an upper layer, which sometimes results in the change in photoelectric characteristics and non-uniformity of the image. Thus, the improvement has been demanded in the application to an electrophotographic apparatus requiring a high image quality of full color.

In order to avoid this problem, the use of a thermosetting resin as a binder resin of a charge-generating layer has been proposed. However, there are a pot life problem that a curing reaction proceeds in a coating solution over the course of time to cause thickening and gelation and a problem that an uncured site remains in film formation and it has an adverse effect on photoelectric characteristics. Thus, the very problem remains substantially unresolved. Further, the charge-generating material such as a pigment cannot completely be insoluble in the coating solvent of the charge transport layer. Consequently, the contamination of a coating bath of the charge transport layer proceeds owing to elution of the charge-generating material with the increase in number of coatings of the photoreceptor, which induces the restriction of the pot life of the coating solution.

With respect to the third defect caused by the laminated structure, when a coherent light of a laser is used as an exposure light source, there arises a problem that a defective image of a stump pattern generally called interference fringe is formed by specular reflection in the interface between the charge-generating layer and the charge transport layer.

In order to avoid this problem, a method in which the interface is rendered uneven and a substrate surface is roughened to scatter light and a method in which a film having a rough surface is formed between a substrate and a photoreceptive layer have been employed. However, these methods themselves involve the increase in costs and require a difficult step of production in which a thin-film charge-generating layer has to be uniformly formed on the rough surface.

Incidentally, as a product to dispel the problems caused by the laminated structure, an electrophotographic photoreceptor of a single-layer structure (monolayer-type photoreceptor) has been long known. However, satisfactory functional separation designing has not been applied to the ordinary monolayer-type photoreceptor, so that it does not have characteristics capable of withstanding practical use. That is, in the ordinary monolayer-type photoreceptor, an insulating resin simply contains a charge-generating material and a charge-transporting material. Owing to the restriction of the transport charge polarity, the concentration of the charge-generating material has to be increased so as to allow optical absorption only in the vicinity of the surface. As a result, there are problems that dark attenuation is increased and photoelectric characteristics are greatly changed due to repetitive use (in the laminated photoreceptor, this problem is controlled by decreasing the film thickness of the charge-generating layer).

Regarding this problem, a monolayer-type photoreceptor in which an insulating resin contains three components, a charge-generating material, a hole-transporting material and an electron-transporting material has been lately proposed, and the remarkable improvement of performance has been attained *(Denshishashin Gakkaishi*, vol. 30, pp. 274–281, 1991). That is, the restriction of the transport charge polarity is removed by adding not only one of the hole-transporting material and the electron-transporting material as in the ordinary photoreceptor but both of these materials. Even though charge is generated inside the photoreceptive layer of the electrophotographic photoreceptor, both charges are transported to opposite poles by the respective charge-transported materials. Consequently, the amount of the charge-generating material c;m extremely be decreased, thereby solving the problem.

However, a resin generally used for a charge transport layer, such as a polycarbonate, is employed as the insulating resin. Thus, it has been problematic in that a dispersibility of the charge-generating material in a coating solution for forming a photoreceptive layer is poor.

As stated above, the charge-generating layer of the functional separation laminated photoreceptor is made of the charge-generating material and the high-polarity resin having a high-polarity group such as a hydroxyl group or a carboxyl group. In the coating solution for forming the charge-generating layer, the high-polarity group of the high-polarity resin is adsorbed on fine particles of the charge-generating material to inhibit agglomeration of the fine particles and provide a stable dispersed state.

When the high-polarity resin is used as the insulating resin of the functional separation monolayer photoreceptor following this thought, the dispersion stability of the coating solution for forming the photoreceptive layer is improved, but a chargeability, a repetitive stability and an environmental stability of the photoreceptor are notably worsened. That is, as stated above, the high-polarity resin is substantially problematic in a charge-transporting property, a moisture absorption and an insulating property. In the functional separation laminated-type photoreceptor, the adverse effect is only minimized by decreasing the thickness of the charge-generating layer containing the high-polarity resin. Thus, it cannot be applied to a monolayer-type photoreceptor in which a photoreceptive layer has a certain thickness.

Further, in order to satisfactorily provide both a hole-transporting ability and an electron-transporting ability in this system in which the hole-transporting material and the electron-transporting material are dispersed in the insulating resin, there is a need to increase a total concentration of these low-molecular charge-transporting materials relative to the insulating resin having mechanical strengths. Thus, there has been a problem that mechanical strengths as a whole film are decreased.

For improving this problem, there is a method in which a polymeric compound is used as one of the charge-transporting materials to provide a film-forming property and an insulating resin is dispensed with. Inventions using specific hole-transporting polymers are disclosed in Japanese Patent Laid-Open No. 256,050/1991, 249,706/1993 and 150,495/1993. However, the hole-transporting polymers used in these inventions do not have themselves the satisfactory mechanical strengths, and further improvement is also required regarding a discharge product resistance and a compatibility with an electron-transporting material. Further, a dispersion stability of the charge-generating material is also problematic in the coating solution for forming the photoreceptive layer.

Moreover, the electrophotographic photoreceptor involves the following problems.

In the electrophotographic photoreceptor, an antioxidant is sometimes added to the photoreceptive layer for protecting the photoreceptor from oxidative gases generated from a charging unit. Further, for improving mechanical strengths of the photoreceptive layer, a crosslinking agent is sometimes added to the coating solution for forming the photoreceptive layer. However, the antioxidant and the crosslinking agent sometimes have an adverse effect on the charge-transporting property. Thus, it has been difficult to add these materials in amounts capable of providing satisfactory effects without having an adverse effect.

SUMMARY OF THE INVENTION

Accordingly, the invention has been made under these circumstances in the related art, and it intends to provide an electrophotographic photoreceptor capable of conquering the problems. The invention provides an electrophotographic photoreceptor having a high performance and a long life which photoreceptor can provide various properties required for a photoreceptor, as occasion demands, by forming a bipolar charge transport layer excellent in hole- and electron-transporting properties, mechanical strengths, a discharge product resistance and a coating dispersion stability as one layer.

The invention further aims to provide a process cartridge and an electrophotographic apparatus having a high image quality and a high durability by using the electrophotographic photoreceptor having the excellent properties.

The present inventors have assiduously conducted investigations on a bipolar charge transport material and a pigment dispersion technology, and have consequently found that the problems can be solved by using a block copolymer or a graft copolymer. Moreover, during the investigations, it has been found that the block copolymer or the graft copolymer generally takes a micro-phase separation structure so that when different functions are imparted to respective structural blocks, they can independently exist in mutually different phases and the respective functions are exhibited to the maximum extents without having adverse effects on the mutual functions, and that the invention can therefore be developed widely in designing the materials requiring plural functions. These findings have led to the completion of the invention.

That is, the invention is an electrophotographic photoreceptor having a bipolar charge transport layer with a hole-transporting property and an electron-transporting property, the bipolar charge transport layer containing a block copolymer or a graft copolymer.

The different functions required for the photoreceptor can be provided together at high levels by imparting the different functions according to the purposes to the respective structural blocks of the block copolymer or the graft copolymer (hereinafter sometimes simply referred to as "block copolymer or the like") incorporated in the bipolar charge transport layer. That is, the different functions are imparted to the respective structural blocks, and the respective structural blocks are subjected to micro-phase separation. Consequently, the materials and the groups having the respective functions are concentrated in the phases to avoid dilution by mixing. Further, the interference of effects of the materials and the groups having the different functions can be inhibited because the respective phases undergo micro-phase separation.

For example, when a block copolymer or the like contains a block having at least one group selected from high-polarity groups such as a hydroxyl group, a carboxyl group and an alkoxysilyl group and having a pigment dispersion stability and a block free of the high-polarity groups, a high pigment dispersibility can be secured by minimizing the adverse effect on a charge-transporting property, a moisture absorption and a chargeability. Accordingly, when this is applied to a monolayer type, a functional separation monolayer-type photoreceptor having excellent properties is realized.

In the invention, it is preferable that the block copolymer or the like has a charge transport active block and a charge transport inactive block. It is more preferable that the charge transport active block is a hole-transporting block containing at least one structure represented by formula (I) as a recurring unit.

(I)

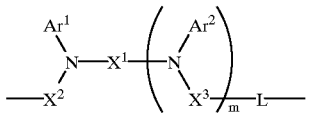

wherein $Ar^1$ and $Ar^2$, independently from each other, represent a substituted or unsubstituted aryl group, $X^1$ represents a divalent hydrocarbon group or a hetero-atom-containing hydrocarbon group having an aromatic ring structure, $X^2$ and $X^3$, independently from each other, represent a substituted or unsubstituted arylene group, L represents a divalent hydrocarbon group or a hetero-atom-containing hydrocarbon group, and m is an integer of 0 or 1.

In the invention, it is advisable that the bipolar charge transport layer contains a charge-generating material. The charge-generating material is preferably an organic pigment, and the content thereof is preferably between 0.1 and 10% by weight.

The bipolar charge transport layer can be used in various organic electronic devices, other than the electrophotographic photoreceptor provided by the invention, such as an organic electroluminescence device, an organic photorefractive device, an organic photosensor and an organic solar cell.

The electrophotographic photoreceptor of the invention is preferably used in a process cartridge which is able to attach to and detach from an electrophotographic apparatus including at least the electrophotographic photoreceptor.

Further, the electrophotographic photoreceptor or the process cartridge of the invention is preferably used in the general electrophotographic apparatus.

BRIEF DESCRIPTION OF THE INVENTION

Preferred embodiments of the invention will be described in detail based on the following figures, wherein.

DESCRIPTION OF THE PREFERRED EMBODIMENTS

The invention is described in more detail below.

Figure 1:
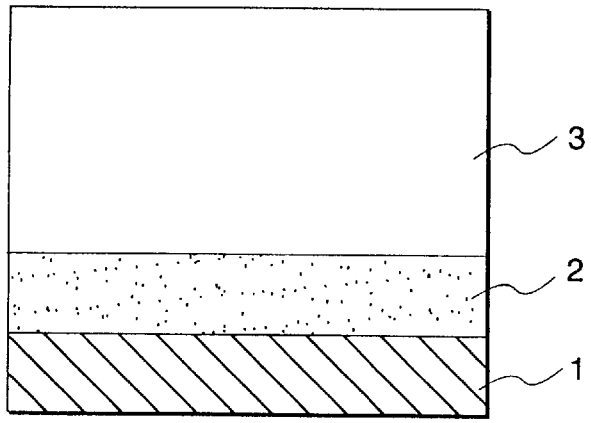
FIG. 1 is a schematic sectional view of an electrophotographic photoreceptor which is an example of the invention.
Figure 2:
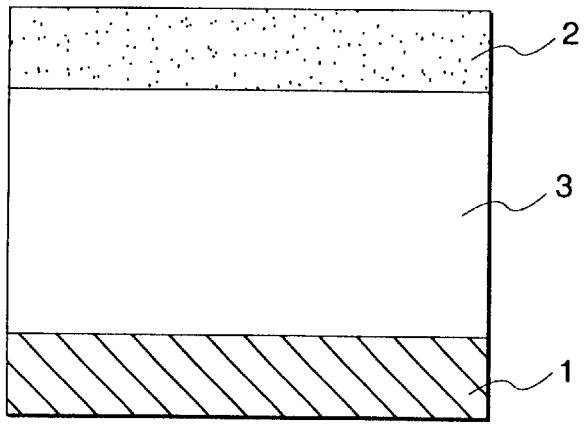
FIG. 2 is a schematic sectional view of an electrophotographic photoreceptor which is another example of the invention.
Figure 3:
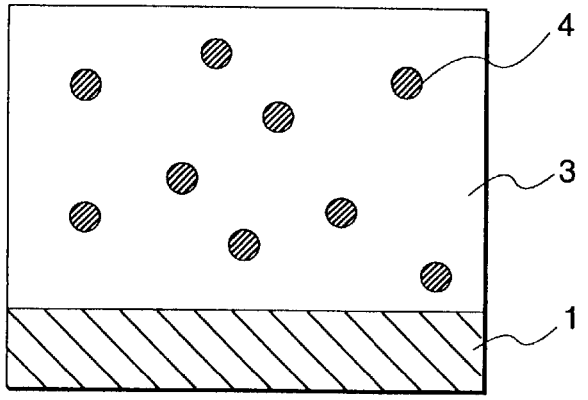
FIG. 3 is a schematic sectional view of an electrophotographic photoreceptor which is still another example of the invention.

A: Overall Construction of the Electrophotographic Photoreceptor of the Invention As the photoreceptive layer in the electrophotographic photoreceptor of the invention, those having structures shown in FIGS. 1 to 3 are mentioned. FIGS. 1 to 3 are schematic sectional views of the electrophotographic photoreceptors of the invention.

In FIG. 1, a charge-generating layer 2 is mounted on a surface of an electroconductive support 1, and a bipolar charge transport layer 3 is formed thereon. In FIG. 2, the bipolar charge transport layer 3 is mounted on the surface of the electroconductive support 1, and the charge-generating layer 2 is formed thereon. In FIG. 3, the bipolar charge transport layer 3 is mounted on the surface of the electroconductive support 1, and fine particles 4 made of a charge-generating material are dispersed in the layer 3.

In these electrophotographic photoreceptors, an undercoat layer, an intermediate layer, a blocking layer, a protecting layer and a monopolar charge transport layer can further be mounted as required.

Among the structures of the photoreceptive layer in the electrophotographic photoreceptor of the invention, a monolayer structure formed by incorporating the charge-generating material in the bipolar charge transport layer as shown in FIG. 3 markedly exhibits preferable effects of the invention. That is, it has advantages in production that the production costs are low because of the monolayer and the productivity is high, and there is no need to conduct special processing of a surface of an electroconductive support which is indispensable for avoiding the problem of the interference fringe in the laminated photoreceptor or to form the undercoat layer which is required to avoid the problem caused by the thin-film charge-generating layer. In this respect, the reduction of the production costs can be realized.

Further, since both holes and electrons generated in the charge-generating material are separately transported by the hole-transporting material and the electron-transporting material, the high charge separation efficiency (namely charge generation efficiency) is attained, and the excellent repetitive stability is realized.

Moreover, because of the excellent bipolar charge transporting ability, such excellent effects are brought forth that the charge-generating material is added in the smallest amount required, the deterioration of the transporting properties by the charge-generating material is suppressed and the decrease in mechanical strengths is also suppressed.

In addition, the charge-generating material and the hole- and electron-transporting materials co-exist, and the photo-excited state is rapidly lost by charge transport. Consequently, there is an advantage that photochemical degradation of an electrophotographic photoreceptor due to light exposure as observed in an ordinary laminated photoreceptor is suppressed. Further, since the electrophotographic photoreceptor has the monolayer structure, the material of the electrophotographic photoreceptor is easily recovered from the electrophotographic photoreceptor discarded and regenerated, which makes it possible to effectively use resources through recycling, to reduce a waste and to cut down costs.

B: Photoreceptive Layer in the Invention

The photoreceptive layer in the invention is described in detail below.

(1) Charge-generating Layer

When the charge-generating layer containing the charge-generating material as shown in FIG. 1 or 2 is formed in the electrophotographic photoreceptor of the invention, any material is available as the charge-generating material so long as it has a charge-generating ability. Examples thereof include inorganic photoconductive materials such as amorphous selenium, hexagonal selenium, a selenium-tellurium alloy, a selenium-arsenic alloy, other selenium compounds and selenium alloys, zinc oxide, titanium oxide, a-silicon and a-silicon carbide; and organic pigments and dyes such as phthalocyanine, squalium, anthoanthrone, perylene, azo, polycyclic quinone, pyrene, pyrrolopyrrole, pyrylium salt and thiapyrylium salt types. Further, these charge-generating materials can be used either singly or in combination.

Of these, the organic pigments are preferable in view of a safety and a fastness. Phthalocyanine pigments are especially preferable as the charge-generating material in the invention because they exhibit an excellent photosentivity at 600 to 850 nm, transmission wavelengths of LED and a laser diode currently used widely in a digital-type electrophotographic apparatus as a light source.

As the phthalocyanine pigments, metal-free phthalocyanines, metallophthalocyanines and their derivatives can be used. Examples of the central metal of metallophthalocyanines include Cu, Ni, Zn, Co, Fe, V, Si, Al, Sn, Ge, Ti, In, Ga, Mg, Pb and Li. Further, oxidized, hydroxylated, halogenated alkylated and alkoxylated derivatives of these central metals are also available. Specific examples thereof can include titanyl phthalocyanine, chlorogallium phthalocyanine, hydroxygallium phthalocyanine, vanadyl phthalocyanine, chloroindium phthalocyanine, dichlorotin phthalocyanine and dimethoxysilicon phthalocyanine. Further, substituted phthalocyanines in which any substituent is introduced into a phthalocyanine ring are also available. Still further, azaphthalocyanines in which any carbon atom in a phthalocyanine ring is substituted with a nitrogen atom are also available.

These phthalocyanine pigments can take an amorphous form or all crystal forms. Of these phthalocyanine pigments, metal-free phthalocyanine, titanyl phthalocyanine, chlorogallium phthalocyanine, hydroxygallium phthalocyanine and dichlorotin phthalocyanine are especially excellent in photosensitivity, and are especially preferable as the (charge-generating material used in the invention.

Moreover, azo-type pigments, polycyclic quinone pigments and perylene-type pigments can preferably be used as the charge-generating material because of the excellent charge-generating efficiency. The shorter the transmission wavelength, the diameter of the laser beam can be reduced more. Accordingly, shortening the wavelength of the exposure laser beam has been studied for providing a higher image quality. Since these pigments have a high photosensitivity from the ultraviolet region to the visible region, they can be used most preferably as the charge-generating material for short-wavelength laser beams.

The charge-generating layer can be formed by a dry method in which the charge-generating material is directly formed into a film through vacuum deposition or a wet-coating method in which a coating solution obtained by dispersing and dissolving the charge-generating material and the binder resin in an appropriate solvent is used, coated and further dried. Examples of the wet-coating method can include usual coating methods such as a blade coating method, a wire bar coating method, a spray coating method, a dip coating method, a bead coating method, an air knife coating method, a curtain coating method and a ring coating method.

When the binder resin is used to form the charge-generating layer, the type of the binder resin is not particularly limited. Examples of the binder resin include a vinyl butyral resin, a vinyl formal resin, a partially modified vinyl acetal resin, a carbonate resin, an ester resin, an acrylic resin, a vinyl chloride resin, a styrene resin, a vinyl acetate resin, a silicone resin, a phenol resin and a vinyl carbazole resin. These binder resins may be block, random and alternating copolymers. Further, they may be used either singly or in combination.

The mixing ratio (weight ratio) of the charge-generating material to the binder resin is preferably between 10/1 and 1/10, more preferably between 5/1 and 1/1. When the mixing ratio of the charge-generating material to the binder resin is higher than this range, dark attenuation is increased, and it is difficult to obtain a uniform film by the wet-coating method. Further, when it is lower than this range, disadvantages such as the decrease in photosensitivity and the increase in residual potential are notably observed.

Examples of the solvent used in producing the coating solution can include usual organic solvents such as toluene, xylene, chlorobenzene, methanol, ethanol, propanol, butanol, benzyl alcohol, methyl cellosolve, ethyl cellosolve, acetone, methyl ethyl ketone, cyclohexanone, methyl acetate, butyl acetate, dioxane, tetrahydrofuran, methylene chloride and chloroform. These can be used either singly or in combination. The amount of the solvent in the coating solution is not absolutely determined. In view of the coating adaptability, it is preferably such an amount that the total solid content in the coating solution is between 0.1 and 20% by weight.

Generally, the film thickness of the charge-generating layer used in the invention is preferably between 0.05 and 5 $\mu$m, more preferably between 0.1 and 2.0 $\mu$m.

(2) Bipolar Charge Transport Layer

The bipolar charge transport layer having the specific structure in the invention features that it has the hole-transporting property and the electron-transporting property and contains the block copolymer or the graft copolymer. Further, the monolayer-type electrophotographic photoreceptor can be formed by further incorporating the charge-generating material in the bipolar charge transport layer.

The hole-transporting property and the electron-transporting property of the bipolar charge transport layer are obtained by incorporating the hole-transporting material and the electron-transporting material in the bipolar charge transport layer. The block copolymer or the like may have a block unit capable of becoming the hole-transporting material and/or the electron-transporting material.

The structures of the blocks of the block copolymer or the graft copolymer are not particularly limited, and the different functions according to the purposes can be imparted thereto.

As the structures of the blocks, those shown in the following a) to d) are listed. Further, the structure shown in e) will be described later.

a) Block Copolymer or the Like Made of a Block Having a High-polarity Group Such as a Hydroxyl Group, a Carboxyl Group or an Alkoxysilyl Group and a Block Free of the High-polarity Group The incorporation of such a block copolymer or the like is especially preferable in view of the pigment dispersibility, and the functional separation monolayer-type photoreceptor using the same exhibits excellent photoelectric properties. This means that the problem given by the high-polarity group is solved by using the block copolymer or the like made of the block having the high-polarity group and the block free of the high-polarity group as the binder resin of the photoreceptive layer while securing the pigment dispersibility with the high-polarity group. The reason for solving the problem given by the high-polarity group is not necessarily clear. It is presumed that since the block copolymer or the graft copolymer has generally the micro-phase separation structure that the individual blocks are separated, the charge-transporting material which has generally a low polarity is preferentially compatible with the phase made of the non-high-polarity block having a high affinity, whereby the material hardly suffers from the adverse effect by the high-polarity group.

Examples of the non-high-polarity block of the block copolymer or the like include a polyolefin block, a polyalkyl acrylate block, a polycarbonate block, a polyester block, a polyether block and a polyimide block. Further, as the non-high-polarity block, the charge-transporting block is also available. When the charge-transporting block copolymer or graft copolymer having the charge-transporting property is used, it has itself a film-forming property. Thus, there is no need to use an insulating resin in combination, and the amount of the charge-transporting material can relatively be increased. Thus, it is especially advantageous in view of the charge-transporting property.

As the charge transport active block, a polymer having at least one structure represented by formula (I) as a recurring unit is preferable in view of a charge-transporting ability, a chemical stability, mechanical strengths and a compatibility with an electron-transporting material.

(I)

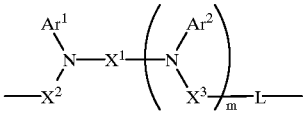

wherein $Ar^1$ and $Ar^2$. independently from each other, represent a substituted or unsubstituted aryl group, $X^1$ represents a divalent hydrocarbon group or a hetero-atom-containing hydrocarbon group having an aromatic ring structure, $X^2$ and $X^3$, independently from each other, represent a substituted or unsubstituted arylene group, L represents a divalent hydrocarbon group or a hetero-atom-containing hydrocarbon group, and m is an integer of 0 or 1.

Specific examples of $Ar^1$ and $Ar^2$ include phenyl, methylphenyl, dimethylphenyl, trimethylphenyl, biphenyl, naphthyl, pyrenyl, fluorophenyl, chlorophenyl and methoxyphenyl groups.

Specific examples of $X^1$ include phenylene, biphenylene, terphenylene, naphthylene, pyrenylene, oxybisphenyl, methylenebisphenyl, cyclohexylidenebispienyl and fluorenylidenebisphenyl groups, and methyl-substituted or halogen-substituted derivatives thereof. In view of the hole-transporting ability and the discharge product resistance, terphenylene and 3,3'-dimethylbiphenylene groups are especially preferable.

Specific examples of $X^2$ and $X^3$ include phenylene and biphenylene groups, and methyl-substituted or halogen-substituted derivatives thereof.

L is preferably a hydrocarbon group or a hetero-atom-containing hydrocarbon group having 1 to 20 carbon atoms. A hetero-atom-containing hydrocarbon group having an ester, ether, carbonate or imide group in a main chain is especially preferable in view of mechanical strengths and a flexibility.

Examples of the high-polarity block of the block copolymer or the graft copolymer include a polyvinyl block containing at least one of acrylic acid, acrylamide, methacrylic acid, metbacrylamide, maleic anhydride, vinyl alcohol, hydroxymethyl methacrylate and γ-trimethoxysilylpropyl methacrylate, a polyalkylene glycol block and a polyamide block.

Specific examples of the block copolymer or the graft copolymer include polystyrene-block-polymethacrylic acid, polycarbonate-block-poly(styrene-co-methacrylic acid) and poly(styrene-co-maleic anhydride)-graft-polyethylene glycol. Further, specific examples of the hole-transporting block copolymer or graft copolymer include those described in Japanese Patent Laid-Open No. 182,760/1998.

It is possible to add to the bipolar charge transport layer, other than the block copolymer or the graft copolymer, a polymer compatible with at least one of the blocks. For example, a block copolymer or a graft copolymer having a polycarbonate block and a polycarbonate having the same structure as the polycarbonate block can be incorporated therein together. Further, a block copolymer or a graft copolymer having a specific charge transport active block and a charge transport polymer having the same structure as the charge transport active block can be incorporated therein together. As a result, the concentration of the high-polarity group can be decreased while securing the pigment dispersibility, and the characteristics of the photoreceptor can further be improved. Incidentally, when the high-polarity polymer and the non-high-polarity polymer are simply mixed, macro-phase separation occurs, and no uniform film can be obtained.

b) Block Copolymer or the Like Made of a Charge-transport-active Block and a Charge-transport-inactive Block In this case, the structure that the charge-transport-active block does not have a high polarity and the charge-transport-inactive block has a high polarity is as described in a) [that is, the structure in a) and the structure in b) can be consistent, and the effects are also as stated in a)].

For example, when a nonpolar structure is employed as a charge-transport-inactive block and a bole-transporting block which has a slight polarity (hereinafter referred to as an intermediate polarity) is employed as a charge-transport-active block, there occurs micro-phase separation into a phase made of a nonpolar charge-transport-inactive block and a phase made of an intermediate-polarity charge-transport-active block. As the electron-transporting material to be separately added to the coating solution for forming the photoreceptive layer, when a material which can preferentially be dispersed in a phase made of the nonpolar charge-transport-inactive block is used, the electron-transporting property and the hole-transporting property are effectively exhibited separately and locally, and the bipolar charge-transporting property is improved as a whole.

c) Block Copolymer or the Like Made of a Charge-transport-active Block and a Block Containing a Group Capable of Hydrogen Bonding; Further the Bipolar Charge-transport Layer Containing an Antioxidant In this structure, there occurs micro-phase separation into a phase made of a block containing a group capable of hydrogen bonding and a phase made of a charge-transport-active block. When a hydrogen-bonding material is used as an antioxidant to be separately added to the coating solution for forming the photoreceptive layer, it is preferentially dispersed in the phase made of the block containing the group capable of hydrogen bonding, and is separated from the charge-transport-active block in micro-mode. The antioxidant has an adverse effect on the charge-transporting property. However, this structure allows the antioxidant and the charge-transport-active block to be separated in micro-mode, making it possible to secure a satisfactory antioxidant effect without having an adverse effect on the charge-transporting property.

Examples of the group capable of hydrogen bonding include hydroxyl, amido, urethane, urea, carboxyl and pyridyl groups.

The antioxidant which is available can be known antioxidants. Examples thereof include hindered phenol, hindered amine, p-phenylenediamine, hydroquinone, spirocumarin, spiroindanone, derivatives thereof, organosulfur compounds and organophosphorus compounds.

d) Block Copolymer or the Like Made of a Charge-transport-active Block and a Block Containing a Crosslinkable Group In this structure, there occurs micro-phase separation into a phase made of a block containing a crosslinkable group and a phase made of a charge-transport-active block. The crosslink-curing is conducted at the crosslinking site of the phase made of the block containing the crosslinkable group in the formation of the bipolar charge transport layer. Since the crosslinkable group has usually a high polarity, it has an adverse effect on the charge-transporting property. However, in this structure, the phase made of the block containing the crosslinkable group and the phase made of the charge-transport-active block undergo micro-phase separation. Accordingly, the bipolar charge transport layer made of the crosslink-cured film having high mechanical strengths is formed without influencing the charge-transporting property.

Examples of the crosslinkable group include self-crosslinkable groups such as alkoxysilyl and hydroxysilyl groups, and groups which exhibit a crosslinking property in combination with a crosslinking aid, such as hydroxyl, carboxyl, epoxy, amido and isocyanate groups.

Examples of the crosslinking aid include a polyisocyanate compound, a polyamino compound, a titanium alkoxide compound, zinc acetate and a polyalkoxysilyl compound.

The molecular weight of the block copolymer or the graft copolymer may be determined, as required, according to a purpose. When a film-forming resin is not used in combination, it is preferably 10,000 or more, more preferably 30,000 or more. At this time, the upper limit of the molecular weight is not limited in theory. However, when the film formation is conducted by the wet-coating method, an appropriate solution viscosity has to be imparted, and the molecular weight is generally required to be 5,000,000 or less. When the other polymer is used in combination and made to have a film-forming property as stated above, the lower molecular weight of the block copolymer or the graft copolymer can be determined. It is advisable that the molecular weight is at least 2,000.

As the electron-transporting material used in the invention, any material will do so long as it has an electron-transport ability. An electron-transporting low-molecular compound having a bulky hydrocarbon group with a branched or cyclic structure in an electron-attractive skeleton is preferable. A high compatibility with a high-molecular component and a high stability in solid solution are exhibited by the bulky hydrocarbon group with the branched or cyclic structure. Further, formation of a charge transfer complex generally formed by mixing a hole-transporting material with an electron-transporting material is inhibited by steric hindrance due to the bulky hydrocarbon group with the branched or cyclic structure. Therefore, unwanted coloration is controlled, and a high bipolar charge-transporting ability is exhibited.

Specific examples of the electron-attractive skeleton in the electron-transporting low-molecular compound include quinone, diphenoquinone, fluorenone, fluorenylidene, malononitrile, fluorenoimine, anthraquinone and aromatic diimide skeletons.

Specific examples of the branched structure contained in the hydrocarbon group in the electron-transporting low-molecular compound include isopropyl, tert-butyl and neopentyl structures.

Specific examples of the cyclic structure contained in the hydrocarbon group in the electron-transporting low-molecular compound include cyclohexyl, norbornyl and adamantyl structures.

Of the electron-transporting low-molecular compounds, diphenoquinone derivatives, fluorenone derivatives and imide derivatives are especially preferable because of the high electron-transporting ability. Specific examples of the preferable electron-transporting low-molecular compounds used in the invention include 3,5-dimethyl-3',5'-diisoproopyldiphenoquinone, 3,5-dimethyl-3',5'-di-tert-butyldiphenoquinone, 3,5-dimethyl-3',5'-dicyclohexyldiphenoquinone, (4-tert-butoxycarbonyl-9-fluorenylidene)malononitrile, (4-norbornoxycarbonyl-9-fluorenylidene)malononitrile, N-(m-methylphenyl) trinitrofluorenoimine, N,N'-di-tert-butylbenzenetetracarboxylic acid diimide, N,N'-dinorbornylbenzenetetracarboxylic acid diimide, N,N'-di-tert-butylnaphthalenetetracarboxylic acid diimide and N,N'-dinorbornylnaphthalenetetracarboxylic acid diimide.

As the hole-transporting material used in the invention, any material will do so long as it has a hole-transporting property. In view of the hole-transporting property and the chemical stability, a low-molecular compound or a high-molecular compound having a triarylamine structure is preferable. A hole-transporting block copolymer or graft copolymer is especially preferable as a hole-transporting material as stated above.

When both the hole-transporting material and the electron-transporting material are polymeric compounds, macro-phase separation generally occurs and no uniform film is obtained. Thus, it is advisable that one of the materials is a low-molecular compound. However, it is possible to control the macro-phase separation such that both of the materials are block copolymers or graft copolymers and contain the blocks of the same structure to make these blocks compatible with each other. Further, when block copolymers or graft copolymers made of blocks having the same structures as the hole-transporting polymer and the electron-transporting polymer to be mixed therewith are used, the copolymers act as a compatibilizing agent, which makes it possible to inhibit the macro-phase separation [this structure is designated e) following a) to d)].

Examples of the low-molecular compound having the triarylamine structure include substituted or unsubstituted triphenylamine, substituted or unsubstituted tetraphenylphenylenediamine, substituted or unsubstituted tetraphenylbenzidine and substituted or unsubstituted bis (diphenylamino)terphenyl. Examples of the substituent include an alkyl group, an aryl group, a halogen atom and an alkoxy group.

The mixing ratio (weight ratio) of the hole-transporting material and the electron-transporting material in the bipolar charge transport layer in the invention is preferably between 1:9 and 9:1, more preferably between 3:7 and 7:3. When the hole-transporting block and/or the electron-transporting block is used as the block of the block copolymer or the like, the mixing ratio (weight ratio) is determined by the weight of the block.

The amount of the block copolymer or the graft copolymer in the bipolar charge transport layer in the invention varies with the purpose and the effect. It is generally set at 0.05 to 90% by weight.

The bipolar charge transport layer in the invention may be formed by any method. In view of the production costs, the simplicity of installation and the mass productivity, a wet-coating method is preferable in which a coating solution is coated by dip coating, blade coating, wire bar coating, spray coating, bead coating, air knife coating, curtain coating or ring coating and this is dried to form a coated film.

The coating solution is prepared by dissolving and dispersing a component materials in an appropriate solvent. Examples of such a solvent include aromatic solvents such as toluene, xylene, chlorobenzene, dichlorobenzene and cresol, cyclic ether solvents such as tetrahydrofuran and dioxane, halogen solvents such as dichloromethane and dichloroethane, ketone solvents such as methyl ethyl ketone, methyl isobutyl ketone and cyclohexanone, ester solvents such as butyl acetate and ethyl acetate, alcohol solvents such as cyclohexanol and butanol, and amide solvents such as dimethylformamide and dimethylacetamide. These can be used either singly or in combination.

The amount of the solvent in the coating solution is not absolutely determined. In view of the coating adaptability, it is preferably such an amount that the total solid content in the coating solution is between 0.1 and 50% by weight, more preferably such an amount that the total solid content in the coating solution is between 1 and 30% by weight.

In the invention, when the charge-generating material is incorporated in the bipolar charge transport layer, the bipolar charge transport layer containing the charge-generating material can be formed by incorporating an appropriate amount of the charge-generating material in the coating solution and coating the resulting coating solution. The construction of the monolayer-type electrophotographic photoreceptor by forming the bipolar charge transport layer containing the charge-generating material is preferable because the merits of the monolayer-type electrophotographic photoreceptor can be utilized.

When an insoluble matter such as a pigment is used as the charge-generating material, it is advisable, for obtaining a uniform and stable coating solution, to prepare a coating solution through treatment by a milling/dispersion method such as a ball mill method, a paint shaking method, an attritor method, a sand mill method and a sonication method.

Examples of the charge-generating material which can be used include those described earlier in the item of the charge-generating layer, and preferable examples are also the same as those described therein.

In the invention, when the charge-generating material is incorporated in the bipolar charge transport layer, the content of the charge-generating material is preferably between 0.05 and 30% by weight, more preferably between 0.1 and 10% by weight, further preferably between 0.3 and 5% by weight. When the content of the charge-generating material is less than 0.05% by weight, an absorbance of the photoreceptive layer is poor, and a photosensitivity is poor. When a coherent light of a laser is used as an exposure light source and a specular electroconductive support is used, a problem of interference fringe sometimes occurs. Meanwhile, when the content of the charge-generating material exceeds 30% by weight, troubles such as the increase in dark current, the decrease in repetitive stability and the decrease in mechanical strengths become great.

In the invention, the film thickness of the bipolar charge transport layer is generally between 5 and 100 $\mu$m, preferably between 10 and 40 $\mu$m, more preferably between 15 and 35 $\mu$m.

C: Other Constructions in the Electrophotographic Photoreceptor of the Invention a) Electroconductive Support The material of the electroconductive support used in the electrophotographic photoreceptor of the invention can be selected from any types that can be used in the art as an electroconductive support in an electrophotographic photoreceptor. It may be opaque or transparent. Specific examples of the material of the electroconductive support include metals such as aluminum, nickel and stainless steel; plastics, glasses and ceramics having thin films of aluminum, titanium, nickel, chromium, stainless steel, gold, platinum, zirconium, tin oxide, indium oxide and ITO; and paper, plastics, glasses and ceramics coated or impregnated with an electroconductivity-imparting agent.

The electroconductive support used in the electrophotographic photoreceptor of the invention can take the form of a belt, a drum, a sheet or a plate as required. Further, the surface of the electroconductive support used in the electrophotographic photoreceptor of the invention can be subjected to various treatments as required. For example, electrolytic oxidation treatment, chemical treatment, mechanical surface-roughening treatment such as sand blasting, rough-cutting or horning, and mechanical mirror-finishing treatment by cutting or polishing can be applied.

b) Undercoat Layer

In the invention, an undercoat layer can be formed between the electroconductive support and the photoreceptive layer for blocking leakage of charge from the electroconductive support to the photoreceptive layer and/or for integrally adhering the photoreceptive layer to the electroconductive support.

As the undercoat layer, known materials can be used. Examples thereof include resins such as an ethylene resin, an acrylic resin, a methacrylic resin, an amide resin, a vinyl chloride resin, a vinyl acetate resin, a phenol resin, a urethane resin, an imide resin, a vinylidene chloride resin, a vinyl acetal resin, a vinyl alcohol resin, a water-soluble ester resin, an alcohol-soluble nylon resin, a nitrocellulose resin, an acrylic acid resin and an acrylamide resin, copolymers thereof, curable metal organic compounds such as a zirconium alkoxide compound, a titanium alkoxide compound and a silane coupling agent. These can be used either singly or in combination. Further, a material capable of transporting only charge having the same polarity as the charging polarity is also available as the material of the undercoat layer.

The undercoat layer can be formed by an ordinary wet-coating method in which a coating solution is coated by blade coating, wire bar coating, spray coating, dip coating, bead coating, air knife coating, curtain coating or ring coating and this is dried to form a coated film. Such a coating solution can be prepared by dissolving and dispersing the components of the undercoat layer in an appropriate solvent. The film thickness of the undercoat layer is preferably between 0.005 and 10 $\mu$m, more preferably between 0.01 and 5 $\mu$m.

c) Monopolar Charge Transport Layer

In the electrophotographic photoreceptor of the invention, a monopolar charge transport layer may be formed together. Especially, when an appropriate monopolar charge transport layer for transporting charge of the same polarity as the charging polarity is formed between an electroconductive support 1 and a bipolar charge transport layer 3 in the structure shown in FIG. 3, a chargeability and an adhesion between the electroconductive support 1 and the bipolar charge transport layer 3 are sometimes improved. Further, when an appropriate monopolar charge transport layer transferring charge of a reverse polarity to the charging polarity is formed on the surface in the structure shown in FIG. 3, an abrasion resistance, a transferability and a cleaning property are sometimes improved.

The monopolar charge transport layer is not particularly limited, and the known structure of the charge transport layer can be applied as such. The monopolar charge transport layer is formed by a wet-coating method in which a coating solution is coated by dip coating, blade coating, wire bar coating, spray coating, bead coating, air knife coating, curtain coating or ring coating and this is dried to form a coated film. Such a coating solution can be prepared by dissolving and dispersing the components of the monopolar charge transport layer in an appropriate solvent. The film thickness of the monopolar charge transport layer is between 1 and 40 μm, preferably between 2 and 10 μm.

d) Protecting Layer

In the invention, a protecting layer that may be formed on the photoreceptive layer as required is effective for protecting the photoreceptive layer from chemical and optical stresses of ozone and oxidative gases generated from the charging material and ultraviolet light and mechanical stresses caused by the contact with a developer, paper and a cleaning member and for improving a substantial life of the electrophotographic photoreceptor. Further, when the protecting layer is used in combination with a charge injection-type charging unit, it serves as a charge injection layer, and allows stable charging by the charge injection-type charging unit.

The protecting layer is generally formed by incorporating an electroconductive material in an appropriate binder resin. Examples of the electroconductive material include metallocene compounds such as dimethylferrocene, and metallic oxides such as antimony oxide, tin oxide, titanium oxide, indium oxide and ITO. However, these materials are not critical.

Examples of the binder resin which are available to form the protecting layer can include known resins such as an amide resin, a urethane resin, an ester resin, a carbonate resin, a styrene resin, an acrylamide resin, a silicone resin, a melamine resin, a phenol resin and an epoxy resin. Further, a semiconducting inorganic film such as amorphous carbon is also available as the protecting layer.

The protecting layer is formed by a wet-coating method in which a coating solution is coated by dip coating, blade coating, wire bar coating, spray coating, bead coating, air knife coating, curtain coating or ring coating and this is dried to form a coated film. Such a coating solution can be prepared by dissolving and dispersing the structural component of the protecting layer in an appropriate solvent. The film thickness of the protecting layer is preferably between 0.5 and 20 μm, more preferably between 1 and 10 μm.

When the protecting layer is formed, a blocking layer for blocking leakage of charge from the protecting layer to the photoreceptive layer can be formed between the photoreceptive layer and the protecting layer as required. In the blocking layer, known materials can be used as in the protecting layer.

e) Other Additives

In the electrophotographic photoreceptor of the invention, additives such as an antioxidant, a light stabilizer and a heat stabilizer can be added to any layer for preventing degradation of the electrophotographic photoreceptor by ozone, oxidative gases, light or heat.

As the antioxidant, known materials can be used. Specific examples thereof are the same as those described in the item of the bipolar charge transport layer.

As the light stabilizer, known materials can be used. Examples thereof include benzophenone, benzotriazole, dithiocarbamate, tetramethylpiperidine, derivatives thereof, and electron-attractive compounds or electron-donating compounds capable of losing the photo-excited state through energy transfer or charge transfer.

As the heat stabilizer, known materials can be used.

Further, fine particles of a fluororesin may be dispersed in the surface layer (any of the protecting layer and the photoreceptive layer will do) for decreasing the surface abrasion, increasing the transferring property or improving the cleaning property.

D: Process Cartridge of the Invention

A process cartridge is so designed that for exchanging consumable parts of the electrophotographic apparatus, some of the parts of the electrophotographic apparatus are inserted in a cartridge to easily exchange the same. The process cartridge is commercially dealt in a state where it is installed in the electrophotographic apparatus, or it is singly dealt as an exchange unit or a repair unit.

Examples of the parts which can be inserted in the process cartridge include a developing unit, a charging unit, an exposure unit and a cleaning unit. These can be used in any combination depending on the purpose.

The process cartridge of the invention features that it includes at least the electrophotographic photoreceptor and any combination of the parts as required and the electrophotographic photoreceptor is the electrophotographic photoreceptor of the invention. The parts, other than the electrophotographic photoreceptor, which can be inserted in the process cartridge, are not particularly limited, and known parts can be employed without problem.

E: Electrophotographic Apparatus of the Invention

As the electrophotographic apparatus in which the electrophotographic photoreceptor of the invention is installed, any apparatus according to electrophotography will do. Especially an electrophotographic apparatus in which exposure is conducted on the basis of digitized image signals is preferable. The electrophotographic apparatus in which the exposure is conducted on the basis of digitized image signals is an electrophotographic apparatus in which exposure is conducted using a light source of a laser or LED according to binary-digit-coded signals or signals multi-digit-coded through pulse-width modulation or intensity modulation. Examples thereof can include a LED printer, a laser printer and a laser exposure digital copier.

When the electrophotographic apparatus of the invention is a less costly and/or small-sized electrophotographic apparatus, it is possible to employ a construction that the surface of the electrophotographic photoreceptor is positively charged. Especially when the electrophotographic photoreceptor of the invention is a monolayer-type photoreceptor and the surface thereof is positively charged, amounts of harmful gases generated are small even though using a wire charge-type charging unit such as an inexpensive scorotron. Thus, there is no need to provide a special construction for removal of harmful gases. Accordingly, the cost reduction and/or the downsizing of the electrophotographic apparatus can easily be realized. Further, since the electrophotographic photoreceptor of the invention is the bipolar charging-type photoreceptor, the problem of charging with a reverse polarity to that in the transfer can basically be solved.

When the monolayer-type electrophotographic photoreceptor is used in the electrophotographic apparatus of the invention, it is especially preferable in view of an image quality that a charging unit for negatively charging the surface of the electrophotographic photoreceptor and a discharge area developing unit are provided.

Figure 4:
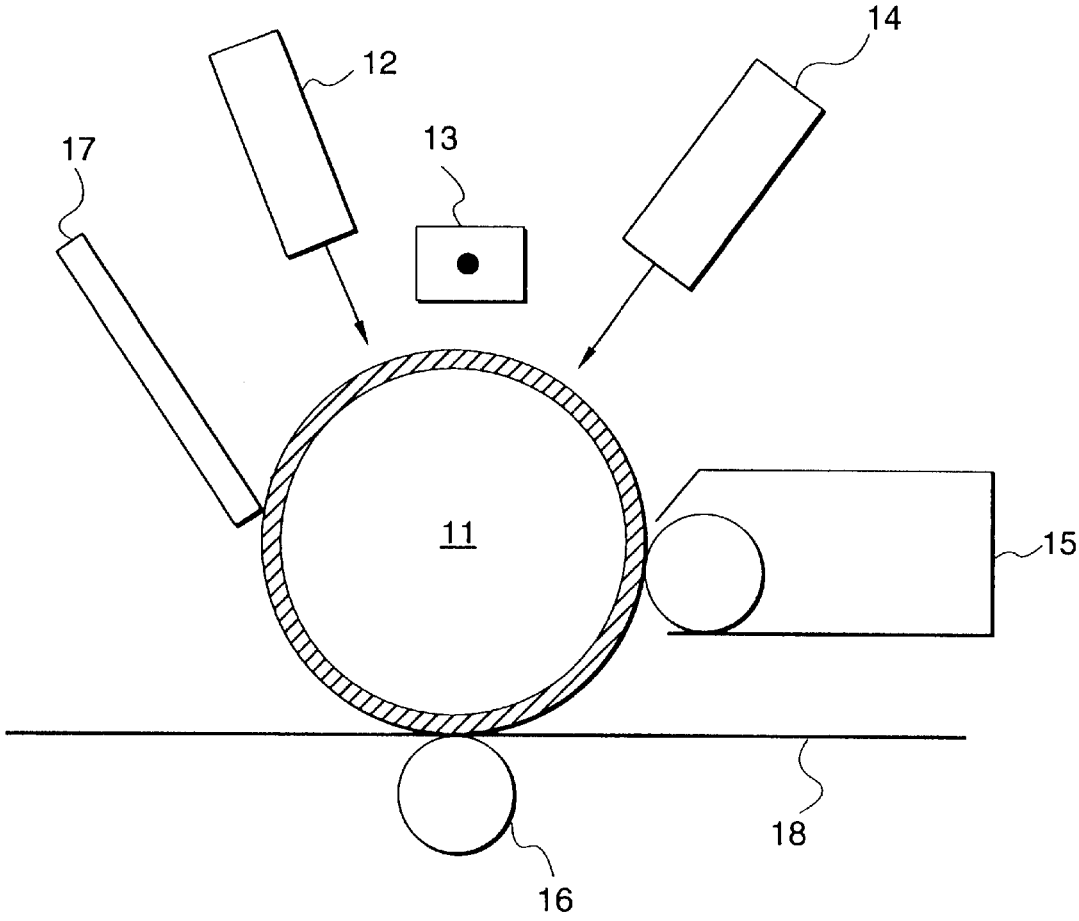
FIG. 4 is a schematic sectional view showing an example of an electrophotographic apparatus of the invention.

An example of the electrophotographic apparatus of the invention is schematically shown in FIG. 4. The electrophotographic apparatus in FIG. 4 is a laser printer in which LED 12 for erase, a charging scorotron 13 as a charging unit, a laser optical system 14 for exposure as an image exposure unit, a developing unit 15, a contact charging roll 16 for transfer and a blade-type cleaning unit 17 are mounted in this order around a cylindrical photoreceptive drum 11 as an electrophotographic photoreceptor. The laser optical system 14 for exposure has, for example, a laser diode for exposure with a transmission wavelength of 780 nm, and light is emitted on the basis of digitized image signals. A laser beam 14*a* emitted is adapted to expose the surface of the electrophotographic photoreceptor while scanning the same with a polygon mirror and plural. lenses and mirrors. Incidentally, reference numeral 18 is paper.

In the electrophotographic apparatus of the invention, the photoreceptor drum 11 is the electrophotographic photoreceptor of the invention. Of course, the apparatus may include the photoreceptor drum 11 and any parts, and also the process cartridge in which the electrophotographic photoreceptor is the electrophotographic photoreceptor of the invention.

The electrophotographic apparatus of the invention has been described by referring to the drawings. However, the invention is not limited to such a construction. The structural parts other than the electrophotographic photoreceptor are not particularly limited and known parts can be employed without problem.

EXAMPLES

The invention is illustrated more specifically by referring to the following Examples and Comparative Examples. However, the invention is not limited thereto, and any modification can be added to the following Examples by those skilled in the art on the basis of known findings of the electrophotographic technology.

Synthesis Example 1

Synthesis of a Hole-transporting Polymer

Three kilograms of N,N'-bis(p,m-dimethylphenyl)-N,N'-bis[p-(2-methoxycarbonylethyl)phenyl]-[3,3'-dimethyl-1,1'-biphenyl]-4,4'-diamine, 9 kg of ethylene glycol and 25 g of tetrabutoxytitanium are mixed, and heat-refluxed in a nitrogen stream for 6 hours. Subsequently, the pressure is reduced to 0.5 mmHg, and the mixture is heated to 215° C. while distilling off ethylene glycol. The reaction mixture is maintained at this temperature for 5 hours. Thereafter, the reaction mixture is cooled to room temperature, and 30 kg of toluene is added thereto to dissolve the resin formed. The insoluble matter is removed through a PTFE filter having a pore diameter of 0.5 $\mu$m, and 150 kg of methyl ethyl ketone si then added to fractionate a high-molecular component precipitated. This is reprecipitated from a tetrahydrofuran/isopropanol mixed solvent to obtain 2.0 kg of a hole-transporting polymer represented by the following structural formula (1) having a hydroxyl group in the end. The weight average molecular weight of the resulting hole-transporting polymer is 62,000 (calculated as polystyrene) as measured by GPC analysis.

Synthesis Example 2

Synthesis of a Block Copolymer Having a Hole-transporting Block Which Comes Under the Category of Formula (1)

Five-hundred grams of the hole-transporting polymer represent by structural formula (1) as obtain in Synthesis Example 1 and 5 g of triethylamine are dissolved in 1.7 liters of toluene, and the solution is cooled to 0° C. To this solution is added 100 g of 4,4'-azobis(4-cyanovaleroyl chloride). The temperature is raised to 35° C., and the reaction is conducted for 6 hours. The reaction mixture was added dropwise to 17 liters of methanol, stirred for 1 hour, and then separated through filtration. Further, reprecipitation from a toluene/methanol mixed solvent is repeated twice to obtain 450 g of a hole-transporting polymer having an azo-type polymerization-initiating group in the end.

The resulting hole-transporting polymer (450 g) having the azo-type polymerization-initiating group in the end is dissolved in 4 liters of toluene, and 350 g of styrene and 10 g of methacrylic acid are added thereto. After the nitrogen substitution, the solution is heated at 75° C. for 100 hours. The resulting solution is added dropwise to 20 liters of methanol, and a solid matter precipitated is separated through filtration. When the filtrate is analyzed, styrene, methacrylic acid and a poly(styrene-co-methacrylic acid) random copolymer are detected.

Subsequently, 400 g of the solid matter separated through filtration is finely divided, washed with a toluene/methanol mixed solvent (mixing ratio 1/4), and dried in vacuo. $^1$H-NMR spectrum and GPC analysis revealed that the resulting product is found to be a mixture of a hole-transporting polymer that do not participate in the radical polymerization and the desired block copolymer (weight composition ratio approximately 2:3). This is hereinafter called a mixture A.

Further, the analysis of $^1$H-NMR spectrum reveal that the weight composition ratio of the charge-transport-active block and the charge-transport-inactive block of the block copolymer is approximately 7:3 and the weight composition ratio of the styrene unit and the methacrylic acid unit in the charge-transport-inactive block is approximately 9:1.

Synthesis Example 3

Synthesis of Polycarbonate-block-poly(Styrene-co-methacrylic Acid)

Synthesis Example 2 was repeated except that bisphenol Z-type polycarbonate with a hydroxyl group in the end, which is formed by a phosgene method, is used instead of the hole-transporting polymer represent by the structural formula (1) as form in Synthesis Example 1 to obtain a mixture make of a polycarbonate which do not participate in the radical polymerization and the desir block copolymer Structural formula (1)

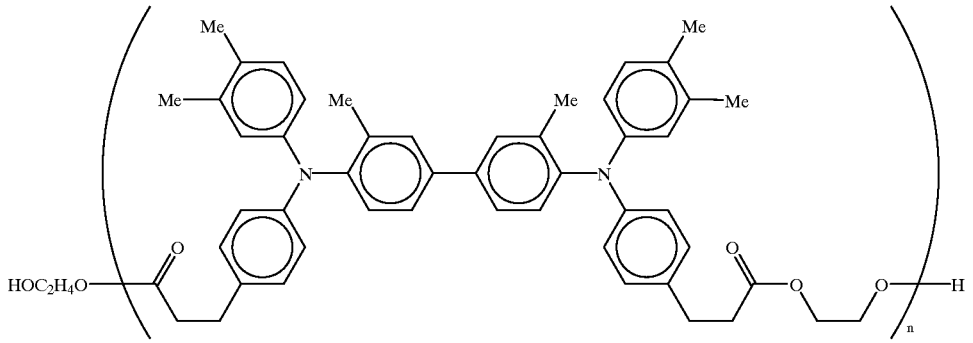

(weight composition ratio approximately 2:3). This is hereinafter called a mixture B.

The analysis of $^1$H-NMR spectrum revealed that the weight composition ratio of the block derived from the polycarbonate of the block copolymer and the block derived from styrene and methacrylic acid is approximately 7:3 and the weight composition ratio of the styrene unit and the methacrylic acid unit derived from styrene and methacrylic acid is approximately 9:1.

Example 1

Two parts by weight of chlorogallium phthalocyanine fine crystals having intense diffraction peaks at Bragg angles (2θ±0.2°) of at least 7.40, 16.60, 25.50 and 28.3° in the X-ray diffraction spectrum using CuKα as a radiation source, 100 parts by weight of cyclohexanone, 300 parts by weight of toluene and 30 parts by weight of isopropanol are mixed, and dispersed by a paint shaking method with SUS beads for 5 hours. Subsequently, 60 parts by weight of the mixture A obtain in Synthesis Example 2 and 38 parts by weight of 3,5-dimethyl-3',5'-di-tert-butyldiphenoquinone as an electron-transporting material are then added thereto, and further dissolved and dispersed by a ball mill method for 2 hours to prepare a coating solution for forming a photoreceptive layer for a monolayer-type photoreceptor.

The resulting coaling solution for forming the photoreceptive layer is coated on an aluminum drum of (electroconductive support) 30 mm in diameter with the surface mirror-finished by dip coating, and heat-dried at 115° C. for 30 minutes to produce a monolayer-type electrophotographic photoreceptor having a structure shown in FIG. 3. The film thickness of the photoreceptive layer was 17 μm.

The thus-obtained electrophotographic photoreceptor is installed in a commercial laser printer (Laser Press 4150 manufactured by Fuji Xerox). The printing test is conducted at room temperature and high humidity (22° C., 70% RH) by continuously developing an image on 1,000 sheets in a transverse direction of A4 sheet. The 1st print sample and the 1,000th print sample after continuously printing 1,000 sheets are visually evaluated, and the results of the evaluation are shown in Table 1. Incidentally, the laser printer used in the evaluation is of the structure shown in FIG. 4, having a charging unit for negative charging and a developing unit of discharge area development system.

Example 2

An electrophotographic photoreceptor is produced in the same manner as in Example 1 except that an aluminum drum of 30 mm in diameter of which the surface is roughened (arithmetic mean roughness Ra=0.20 μm) through wet-horning treatment with alumina particles is used, and the evaluation is conducted as in Example 1. The results of the evaluation are shown in Table 1.

Example 3

An electrophotographic photoreceptor is produced in the same manner as in Example 1 except that an aluminum drum of 84 mm in diameter of which the surface is mirror-finished is used as an electroconductive support.

The thus-obtained electrophotographic photoreceptor is installed in a commercial full-color laser copier (A-Color 935 manufactured by Fuji Xerox). The copying test was conducted at room temperature and high humidity (22° C., 70% RH) by continuously developing an image on 1,000 sheets in a transverse direction of A4 sheet. The first printed sample and the 1,000$^{th}$ printed sample after continuously printing 1,000 sheets are visually evaluated, and the results of the evaluation are shown in Table 1. Incidentally, the full-color laser copier use in the evaluation has a charging unit for negative charging and a developing unit of discharge area development system.

Example 4

An electrophotographic photoreceptor is produced in the same manner as in Example 1 except that the electron-transporting material is changed to 4-(1,2-dimethylpropoxy) carbonyl-9-fluorenylidenemalononitrile, and the evaluation is conducted as in Example 1. The results of the evaluation are shown in Table 1.

Example 5

An electrophotographic photoreceptor was produced in the same manner as in Example 1 except that the electron-transporting compound is changed to N-cyclohexyl-N'-(1,2-dimethylpropyl)- 1,4,5,8-naphthalenetetracarboxylic acid diimide, and the evaluation is conducted as in Example 1. The results of the evaluation are shown in Table 1.

Example 6

An electrophotographic photoreceptor is produced in the same manner as in Example 3 except that 48 parts by weight of the mixture B obtained in Synthesis Example 3 is used instead of 60 parts by weight of the mixture A obtained in Synthesis Example 2, the amount of the electron-transporting material was changed to 30 parts by weight and 20 parts of weight of bis(p,m-dimethylphenyl) biphenylamine as one type of a hole-transporting material having a triarylamine structure is further added. The evaluation is conducted as in Example 3. The results of the evaluation are shown in Table 1.

Example 7

An electrophotographic photoreceptor is produced in the same manner as in Example 1 except that the coating solution for forming the photoreceptive layer for the monolayer-type photoreceptor is allowed to stand in a closed condition at room temperature for 1 month and then coated. The evaluation is conducted as in Example 1. The results of the evaluation are shown in Table 1.

Comparative Example 1

An electrophotographic photoreceptor is produced in the same manner as in Example 3 except that the electron-transporting material is not added and the amount of the mixture A obtained in Synthesis Example 2 is changed to 98 parts by weight. The evaluation is conducted as in Example 3. The results of the evaluation are shown in Table 1.

Comparative Example 2

An electrophotographic photoreceptor is produced in the same manner as in Example 3 except that bisphenol Z-type polycarbonate is used instead of the mixture A obtained in Synthesis Example 2, and the evaluation is conducted as in Example 3. The results of the evaluation are shown in Table 1.

Comparative Example 3

Three parts by weight of chlorogallium phthalocyanine fine crystals having intense diffraction peaks at Bragg angles (2θ±0.20°) of at least 7.4°, 16.6°, 25.5° and 28.3° in the X-ray diffraction spectrum using CuKα as a radiation source is mixed with 3 parts by weight of a vinyl chloride-vinyl acetate-maleic anhydride copolymer (VMCH made by Union Carbide), 60 parts by weight of xylene and 40 parts by weight of butyl acetate, and dispersed by a paint shaking method with SUS beads for 5 hours to prepare a coating solution for forming a charge-generating layer. The resulting coating solution is coated on an aluminum drum (electroconductive support) at 30 mm in diameter with the surface mirror-finished by dip coating, and heat-dried at 135° C. for 5 minutes to form a charge-generating layer having a film thickness of 0.2 μm.

Subsequently, 10 parts by weight of the hole-transporting polymer obtain in Synthesis Example 1 and 40 parts by weight of toluene are mixed to prepare a coating solution for forming a charge transport layer. The resulting coating solution is coated on the charge-generating layer by the dip coating method, and heat-dried at 115° C. for 30 minutes to form a monopolar charge transport layer having a film thickness of 17 μm and produce a laminated electrophotographic photoreceptor. The resulting electrophotographic photoreceptor was evaluated as in Example 1. However, since the image quality is extremely bad from the outset, the printing test was interrupted. The results of the evaluation are shown in Table 1.

Comparative Example 4

An electrophotographic photoreceptor is produced in the same manner as in Comparative Example 1 except that an aluminum drum of 30 mm in diameter of which the surface is roughened (arithmetic mean roughness Ra=0.20 μm) through wet-horning treatment with alumina particles is used, and the evaluation is conducted as in Example 1. However, since the image quality is extremely bad from the outset, the printing test is interrupted. The results of the evaluation are shown in Table 1.

Comparative Example 5

An electrophotographic photoreceptor is produced in the same manner as in Example 6 except that poly(styrene-co-methacrylic acid) is used instead of the mixture B obtained in Synthesis Example 3. After the coating solution for forming the photoreceptive layer is coated, the growth of crystals considered to be the electron-transporting material is observed in the heat-drying. The evaluation is conducted as in Example 1 using the resulting electrophotographic photoreceptor of Comparative Example 5. However, since the image quality is extremely bad from the outset, the printing test is interrupted. The results of the evaluation are shown in Table 1.

Comparative Example 6

A coating solution for forming a photoreceptive layer for a monolayer-type photoreceptor is prepared in the same manner as in Example 1 except that the hole-transporting high-molecular compound represent by structural formula (1) as obtain in Synthesis Example 1 is used instead of the mixture A obtain in Synthesis Example 2. The resulting coating solution for forming the photoreceptive layer is allowed to stand in a closed condition at room temperature for 1 month as in Example 7. Then, agglomeration of pigment particles proceed to provide a non-uniform coating solution. Thus, the dip coating is impossible.

TABLE 1

| | Image guality of 1st sheet | Image quality of 1,000th sheet |
|---|---|---|
| Example 1 | Good | Good |
| Example 2 | Good | Good |
| Example 3 | Good | Good |

TABLE 1-continued

| | Image guality of 1st sheet | Image quality of 1,000th sheet |
|---|---|---|
| Example 4 | Good | Good |
| Example 5 | Good | Good |
| Example 6 | Good | Good |
| Example 7 | Good | Good |
| Comparative Example 1 | Density is low. | Density is notably decreased. |
| Comparative Example 2 | Density is low. | Density is notably decreased. |
| Comparative Example 3 | Clear interference fringe occurs in half tone region. | — |
| Comparative Example 4 | Many black microspots occur and remarkable density unevenness is observed in half tone region. | — |
| Comparative Example 5 | Density is decreased and remarkable density unevenness is observed in half tone region. | — |

As shown in Table 1, the electrophotographic photoreceptor of the invention has the excellent repetitive stability and provides the stable high-quality image over a long term. Further, it has excellent characteristics that the interference fringe does not occur regardless of the surface condition of the electroconductive substrate and the density unevenness does not occur by using the rough electroconductive substrate without forming the undercoat layer. Thus, the problems associated with the laminated electrophotographic photoreceptor described above are overcome. Still further, the use of the specific block copolymer or graft copolymer provides the high pigment dispersibility, and the outstanding effect that the pot life of the coating solution for forming the photoreceptive layer is quite long is brought forth in the production of the functional separation monolayer-type photoreceptor.

As has been stated above, the electrophotographic photoreceptor having the specific bipolar charge transport layer of the invention brings forth the outstanding effects such as the high performance and the excellent durability. Consequently, the electrophotographic apparatus having the electrophotographic photoreceptor in the invention can realize the excellent image quality over a long term. Further, the monolayer-type electrophotographic photoreceptor capable of overcoming the problems associated with the ordinary laminated electrophotographic photoreceptor can be provided. Thus, it is possible to provide the electrophotographic photoreceptor at low costs.

What is claimed is:

1. An electrophotographic photoreceptor having a bipolar charge transport layer with a hole-transporting property and an electron-transporting property, the bipolar charge transport layer containing a block copolymer or a graft copolymer, wherein the block copolymer or the graft copolymer exhibits a micro-phase separation structure.

2. The electrophotographic photoreceptor as claimed in claim 1, wherein the block copolymer or the graft copolymer has a charge-transporting property.

3. The electrophotographic photoreceptor according to claim 1, wherein the block copolymer contains one structure represented by formula (I) as a recurring unit:

(I)

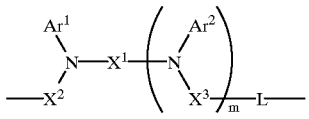

wherein $Ar^1$ and $Ar^2$, independently from each other, are a substituted or unsubstituted aryl group, $X^1$ is a divalent hydrocarbon group or a hetero-atom-containing hydrocarbon group having an aromatic ring structure, $X^2$ and $X^3$, independently from each other, are a substituted or unsubstituted arylene group, L is a divalent hydrocarbon group or a hetero-atom-containing hydrocarbon group, and m is an integer of 0 or 1.

4. The electrophotographic photoreceptor as claimed in claim 1, wherein the block copolymer or the graft copolymer has a block having at least one group selected from the group consisting of a hydroxyl group, a carboxyl group and an alkoxysilyl group, and a block having no group selected from the group consisting of a hydroxyl group, carboxyl group and an alkoxysilyl group.

5. The electrophotographic photoreceptor as claimed in claim 1, wherein the bipolar charge transport layer contains a charge-generating material.

6. The electrophotographic photoreceptor as claimed in claim 5, wherein the charge-generating material is an organic pigment, and the content of the organic pigment is between approximately 0.1 and approximately 10% by weight.

7. A process cartridge which is able to attach to or detach from an electrophotographic apparatus, the process cartridge including the electrophotographic photoreceptor as claimed in claim 1.

8. An electrophotographic apparatus including the electrophotographic photoreceptor as claimed in claim 1.

9. An electrophotographic apparatus including the process cartridge as claimed in claim 7.

10. The electrophotographic photoreceptor according to claim 1, wherein the block copolymer or the graft copolymer comprises at least one charge-transport-active block, and at least one charge-transport-inactive block.

11. The electrophotographic photoreceptor according to claim 1, wherein the bipolar charge transport layer contains an antioxidant, and the block copolymer or the graft copolymer comprises at least one charge-transport-active block and at least one block selected from a group capable of hydrogen bonding.

12. The electrophotographic photoreceptor according to claim 1, wherein the block copolymer or the graft copolymer comprises at least one charge-transport-active block, and at least one block selected from a group capable of crosslinking.

* * * * *